United States Patent [19]

Morse

[11] 4,371,251

[45] Feb. 1, 1983

[54] ELECTROGRAPHIC METHOD AND APPARATUS PROVIDING IMPROVED TRANSFER OF NON-INSULATIVE TONER

[75] Inventor: Theodore H. Morse, Rochester, N.Y.

[73] Assignee: Eastman Kodak Company, Rochester, N.Y.

[21] Appl. No.: 239,100

[22] Filed: Feb. 27, 1981

[51] Int. Cl.[3] ..... G03G 15/00

[52] U.S. Cl. ..... 355/3 TR; 430/126; 355/16; 355/77

[58] Field of Search ..... 355/3 TR, 16, 3 BE, 355/3 R, 77; 430/126, 31

[56] References Cited

U.S. PATENT DOCUMENTS

| | | | |
|---|---|---|---|
| 3,132,050 | 5/1964 | Huber | 118/637 |
| 3,166,432 | 1/1965 | Gundlach | 117/17.5 |
| 3,563,734 | 2/1971 | Shely | 96/1.4 |
| 3,781,105 | 12/1973 | Meagher | 355/3 |
| 3,816,840 | 6/1974 | Kotz | 346/74 ES |
| 3,832,055 | 8/1974 | Hamaker | 355/3 R |
| 3,845,951 | 11/1974 | Hamaker | 271/243 |
| 3,866,572 | 2/1975 | Gundlach | 118/637 |
| 3,879,121 | 4/1975 | Simpson | 355/3 R |
| 3,909,258 | 9/1975 | Kotz | 96/1 R |
| 3,924,943 | 12/1975 | Fletcher | 355/3 R |
| 4,081,212 | 3/1978 | Wetzer | 430/126 X |
| 4,110,031 | 8/1978 | Ebi et al. | 355/3 TR |
| 4,114,536 | 9/1978 | Kaneko et al. | 355/3 TR |
| 4,183,655 | 1/1980 | Umahashi et al. | 355/3 TR |

*Primary Examiner*—R. L. Moses

*Attorney, Agent, or Firm*—John D. Husser

[57] ABSTRACT

Method and apparatus for transferring non-insulative toner, having charge of a first polarity, from an electrically-insulative image member to a transfer member of high relative-conductivity, features feeding successive portions of such members into opposing relation at a transfer zone, contacting the non-opposing surface of such transfer member portions with a compliant, conductive surface biased to a polarity opposite said first polarity and controlling contact between such member portions to extend for a predetermined period not exceeding 0.030 seconds.

14 Claims, 4 Drawing Figures

ELECTROGRAPHIC METHOD AND APPARATUS PROVIDING IMPROVED TRANSFER OF NON-INSULATIVE TONER

BACKGROUND OF THE INVENTION

1. Field of the Invention

The present invention relates to electrographic imaging apparatus and methods and more particularly to improved devices and methods for transferring non-insulative toner to a transfer member of the kind having a high relative-conductivity.

2. Brief Description of the Prior Art

The most popular commercial form of electrographic imaging is the one in which electrostatic images, produced by exposure of a uniformly pre-charged photoconductor member, are developed with tribo-electrically-charged, electrically insulative toner particles. The developed images are, in turn, electrostatically transferred and fused to plain paper of the kind having a high relative-conductivity. In this procedure, the insulative toner is triboelectrically charged by a rubbing action with contiguous carrier particles, and this has presented problems in several regards. For example, the toner-to-carrier ratio of the developer mixture must be monitored and controlled precisely to achieve uniform density of development. Also, carrier particles of such developer mixtures become ineffective after extended use and must be replaced. Further, the carrier particles will abrade the imaging member if extreme care is not exercised. Of course, the carrier adds additional cost and complexity to the system.

In view of such problems with the carrier-toner approach, much effort has been devoted to designing a single-component (i.e. having only toner and no carrier) development system. Many single component developer approaches have been suggested; however, to this point only the single-component developer approach that has found substantial commercial usage is one using a toner that is electrically non-insulative and magnetic. In this approach a magnetic brush applies the toner particles to the electrostatic image, e.g., as disclosed in U.S. Pat. No. 3,816,840, and development occurs by an induced charge mechanism such as is explained in U.S. Pat. No. 3,166,432. There has been a significant limitation to the non-insulative toner approach, however. Specifically, non-insulative toner is extremely difficult to transfer to supports having high relative-conductivity, such as plain paper. The commercial implementations therefore have been with photoconductive coated paper, such as zinc oxide copy sheets, or with insulative coated papers, such as resin-coated copy sheets. Such coated copy sheets are not as desirable as plain paper from either the cost or esthetic viewpoints. Thus it would be highly advantageous to have a structural approach facilitating high quality electrographic imaging with non-insulative toner and transfer media of high relative-conductivity such as plain paper copy sheets.

SUMMARY OF THE INVENTION

It is the purpose of the present invention to provide such a structural approach; and, therefore it is one aspect of the invention to provide method and apparatus for improving the transfer of non-insulative toner images.

A more specific object of the present invention is to provide improved apparatus and method which can effect high quality electrostatic transfer of non-insulative toner from insulative imaging members (including photoconductive insulator members) to transfer members of high relative-conductivity.

In general the present invention achieves these objectives and advantages by: (1) feeding, through a transfer zone, successive portions of an insulative member bearing a non-insulative toner image having an electrostatic charge of a first polarity; (2) feeding, through said transfer zone in opposing relation to said portions of said insulating member, successive sections of a transfer member having a high relative-conductivity; (3) electrically biasing the non-opposing surface of transfer member portions within said transfer zone to a potential of polarity opposite to said first polarity; and (4) contacting said opposing transfer member and insulator member portions within said transfer zone for a period within the range of from about 0.015 to about 0.030 seconds.

In another aspect the present invention provides as an improvement in electrographic apparatus of the kind having means for forming a non-insulative toner image, bearing charge of a first polarity, on an insulating member, a device for transferring such toner image to a transfer member of high relative-conductivity, said device comprising (1) means for feeding successive portions of said insulating member and such transfer member into opposing relation at a transfer zone; (2) means for contacting the non-opposing surface of transfer member portions in said transfer zone with a source of electrical potential of polarity opposite said first potential and (3) means for controlling contact of the successive insulator member and transfer member portions in said transfer zone to extend for a predetermined period in the range of from about 0.015 to about 0.030 seconds.

BRIEF DESCRIPTION OF THE DRAWINGS

The above and other objects and advantageous features of the present invention will be further understood in consideration of the following detailed description of preferred embodiments of the invention which is set forth with reference to the attached drawings wherein.

DETAILED DESCRIPTION OF THE PREFERRED EMBODIMENTS

Figure 1:
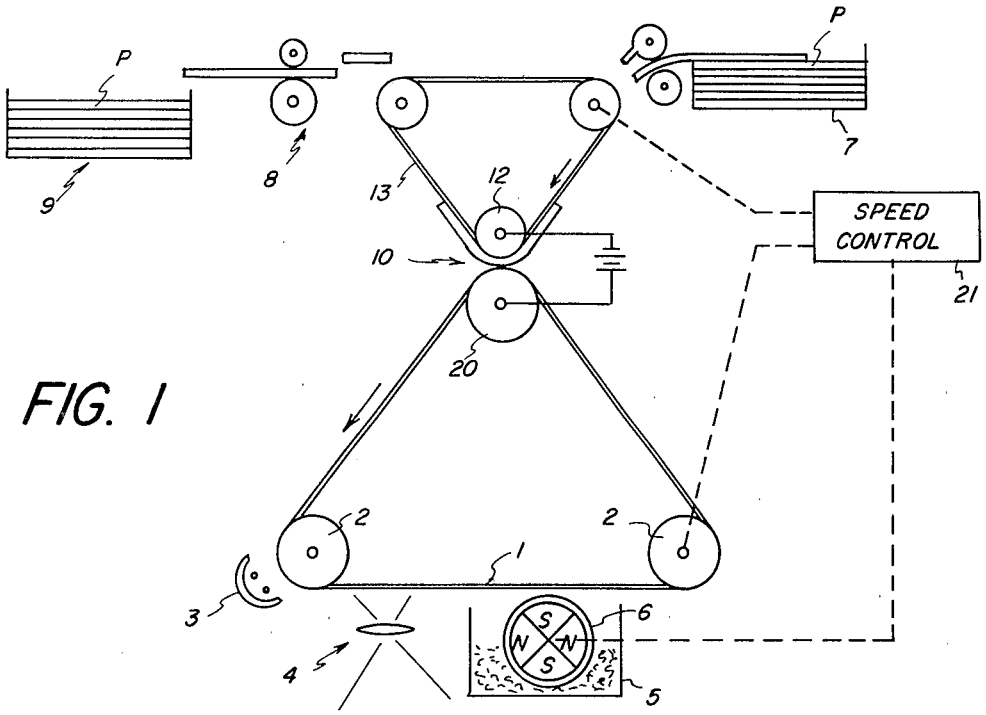
FIG. 1 is a schematic side view illustrating one apparatus for practice of the present invention.

Referring to FIG. 1, one embodiment for practice of the present invention comprises an imaging member 1 in the form of a continuous web photoconductor which is fed around an operative path past a series of processing stations which cooperate for forming and developing electrostatic images. Typically the photoconductor can include a photoconductive insulator layer overlying a thin conductive layer on a support web. The dark conductivity of such insulator layer preferably is in the range of about $10^{13}$ to about $10^{16}$ ohm-cm. As it is fed along the endless operative path by drive rollers 2, the photoconductive surface of image member 1 is first subjected to a uniform primary electrostatic charge from corona discharge unit 3, then imagewise exposed to light at exposure station 4. The resulting latent electrostatic image on the photoconductor is then developed, e.g., by a magnetic brush, at development station 5.

Such development in the illustrated embodiment is effected with single-component toner which is electrically non-insulative and magnetic. As used herein with reference to toner, the term "non-insulative" means having a volume resistivity not significantly exceeding $10^{10}$ ohm-cm. A general range for such toner resistivity is from about $10^4$–$10^{10}$ ohm-cm. A preferred range for such toner resistivity is from about $10^6$ to about $10^8$ ohm-cm. A preferred average toner particle size is in the range of from about $10\mu$ to about $30\mu$ microns; however, the invention is operable with average particle size developers outside these preferred limits. As shown, the toner particles are applied to the image member by rotating a magnetic cylinder inside a stationary non-magnetic shell. U.S. Pat. No. 3,816,840 discloses one such apparatus and procedure in more detail.

After imagewise development as described above, the photoconductor moves through transfer station 10 wherein electrostatic transfer of the toner image to transfer members P, such as copy sheets or webs, of high relative-conductivity is effected in accordance with the present invention. The term "high relative-conductivity" is used herein to define such members having a resistivity in the range from about $10^9$ to about $10^{12}$ ohm-cm. This definition includes most untreated plain paper, such as Bond paper, in normal humidity ranges wherein copying will occur, but does not include dielectric coated papers which typically have resistivity in the order of $10^{16}$ ohm-cm. Similarly, the definition is intended not to include highly conductive, metal-like substrates having resistivity much less than $10^9$ ohm-cm.

As shown the copy sheets P can be fed from a supply 7 through the transfer station, into fusing rollers 8, which fix the transferred toner image, and finally into a receiving bin 9.

Figure 2:
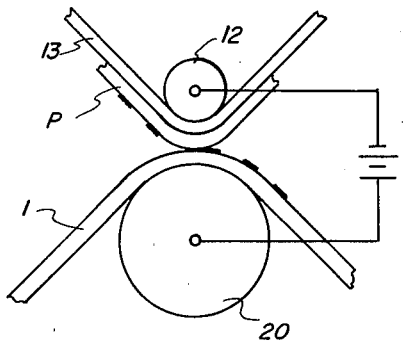
FIG. 2 is an enlarged view of a portion of FIG. 1.

Referring now to FIG. 2, the improved transfer apparatus and method of the present invention will be described in more detail. As can be seen better in this enlarged view, successive portions of the imaging member 1, bearing their developed toner image portions, pass sequentially through the transfer station. Before the image member portions pass into the transfer station, the toner thereon is attracted to the photoconductor by the electrostatic charge of the latent image, which is of the polarity dictated by the primary charger 3 (in this instance positive).

Figure 3:
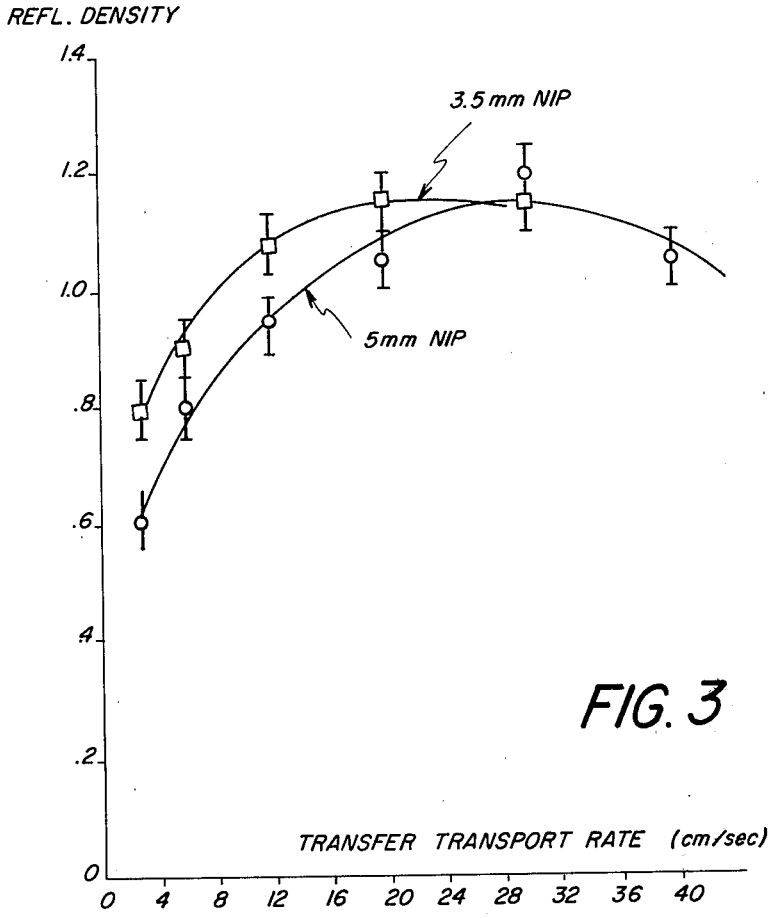
FIG. 3 is a graph plotting transferred image density versus transferring speed for two different contact zone lengths thus illustrating the variation in the density of toner transferred with the variation of transfer period.

I have found that transfer of the toner from successive portions of image member 1 to opposing portions of transfer member P, fed through the transfer zone at the same speed as the photoconductor, can be effected with good quality when: (1) a potential of polarity opposite to the charge on the toner is provided in contact across the non-opposing side of the transfer member portions that are in the transfer region, and (2) the period of contact between the image member portions and the transfer member portions is predeterminedly controlled. More specifically, I have found that if such contact period is too long the density of transferred toner decreases drastically. This effect is shown graphically in FIG. 3, which is a plot of the variation of reflection density (of non-insulative toner images transferred to a transfer member of high relative-conductivity) with respect to the variation in the transport rate through two different transfer stations such as shown in FIG. 2. Two factors should be noted. First, it will be seen that the density of toner transferred by the roller forming a 3.5 mm nip (i.e. contact zone) becomes high at lower transport rates than the roller providing a 5 mm nip. Second, it will be seen that the density of the toner image transferred becomes higher for both stations with increasing transfer rate.

Thus it is a significant aspect of the present invention to feed successive portions of the image member and the transfer sheet, of high relative-conductivity, through transfer relation in a manner providing contact therebetween for such a predeterminedly controlled period. The optimal magnitude for such contact period varies slightly with the resistivity variation of the conductive toners and more markedly with the resistivity of the transfer member. However for non-insulative toners and transfer members of high relative-conductivity as defined herein, I have found that good transfer density can be achieved if the transfer period does not exceed 0.030 seconds. It is believed that transfer periods of such short durations, i.e. not exceeding 0.030 seconds, obtain such enhanced density in toner transfer by avoiding excessive discharge of the toner. Thus, it is a significant aspect of the present invention to provide for a contact period of predeterminedly limited duration such that the toner has a significant residual charge at the end of the contact period.

It will be realized that the transfer period is a function of the velocity through the transfer zone of the transfer member (and juxtaposed photoconductor), and of the length, along the transfer member's path, of the zone of contact between the members. Thus a given period can be achieved by having a first, predetermined transfer member velocity and a first, predetermined contact zone length or by having a second, predeterminedly slower transfer member velocity and a second, predeterminedly shorter contact zone length. Either or both of these parameters can be predeterminedly varied, in accordance with the present invention, to optimize the transfer density for particular operating conditions. Exemplary embodiments for implementing such contact period control are described below; however, it is a significant aspect of the present invention that the combination of these speed and length parameters provide a resultant contact period not exceeding 0.030 seconds.

In operating with such short duration periods of transfer contact, I have noted one other effect. Although extremely short contact times yield good density in the transferred toner image, these short duration periods make contact uniformity quite important. I noted that in some modes of operation with short duration transfer periods, there exists a degree of mottle (i.e., areas of non-uniformity of density in areas which should have uniform density) within the transferred image. I have found that transfer periods as short as 0.015 seconds can be utilized without such mottling by providing a uniformly-smooth, compliant, conductive surface as the means of applying an electrical bias to the back of the transfer member.

The transfer apparatus 10 shown in FIGS. 1 and 2 illustrates one preferred means for implementing transfer in accordance with the present invention. In FIGS. 1 and 2 it can be seen that successive portions of the image member 1 and transfer member P are fed by a conductive web 13 between back-up roller 20 and transfer roller 12. The transfer member can be attracted to the web 13 electrostatically or by vacuum. Alternatively the transfer member feed can be directly into the nip between the web 13 and photoconductor so that the need for attraction to the web 13 is obviated. It will be noted that transfer roller 12 is of small diameter to define a relatively small nip at the zone through which the transfer contact occurs. This is desirable to facilitate short contact periods at relatively slow transfer member speeds.

Preferably, the roller 12 is compliant (e.g., formed of soft, conductive foam rubber ) and is disposed to resiliently urge intimate contact between the successive portions of the transfer member and image member passing within its nip. I have found that using a flexible conductive web 13 as an interface between such a compliant roller and the transfer sheet, is a highly desirable configuration for obviating the mottle phenomenon noted above. Thus the compliant roller 12 urges the transfer member P into intimate contact with the photoconductor 1, and the interposed flexible web 13 provides means for causing such contact to be uniform throughout the nip. I have found that potentials in the range of 500 to 1500 volts opposite to the charge on the toner particles can provide desirable transfer when applied to a roller such as 12 operating over the proper contact period. Preferred voltages are in the range of 500 to 1100 volts of such opposite polarity.

In the FIG. 1 embodiment speed control means 21 is provided to allow adjustment of the contact period. Such control means regulates the velocity of the photoconductor 1 (e.g. via drive roller 2), the transport rate of developer (e.g. via magnetic brush 6) and the velocity of transfer member P (e.g. by the drive for back-up web 13). Thus to predeterminedly adjust the contact period (e.g. to compensate for a variation in transfer member conductivity due to relative humidity change) the speed control can be adjusted to change the velocity of the photoconductor's and transfer member's passage through the exposure zone, as well as the rate of the other cooperating stations of the FIG. 1 apparatus.

Figure 4:
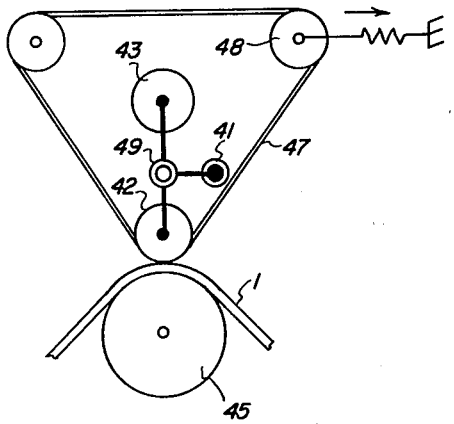
FIG. 4 is a schematic view illustrating an alternative means for regulating the transfer period.

FIG. 4 shows an alternative embodiment for controlling the contact period by controlling the length of the contact zone. In this embodiment three different diameter rollers 41, 42 and 43 are rotatable on shafts that are selectively indexable into transfer-zone-defining orientations. Thus when roller 42 is in the transfer-zone-defining orientation as shown, a zone of intermediate length results, when roller 41 is indexed opposite roller 45 a shorter transfer zone results and when roller 43 is moved opposite roller 45 a longer transfer zone results. Conductive web 47 is provided as in the FIG. 1 embodiment, however, its path is defined by movable, spring-biased roller 48 to compensate for the different transfer zone lengths. By indexing shaft 49, the length of transfer zone can be adjusted to provide an optimum contact period and achieve the same regulation aspect as provided by speed control means 21 of the FIG. 1 embodiment.

The invention has been described in detail with particular reference to certain preferred embodiments thereof, but it will be understood that variations and modifications can be effected within the spirit and scope of the invention.

What is claimed is:

1. In a process for electrographic imaging using an electrically insulative imaging member, electrically non-insulative toner and a transfer member of high relative-conductivity, the improved toner transfer procedure comprising:

(a) moving successive portions of such an imaging member, bearing non-insulative toner having a charge of a first polarity, through a transfer zone;

(b) moving successive portions of such a high relative-conductivity transfer member through said transfer zone in opposing relation to respective portions of the toner bearing surface of said insulative imaging member;

(c) electrically biasing the non-opposing surface of said transfer member portions within said transfer zone at a predetermined potential level, opposite in polarity to said first polarity; and (d) contacting said opposing transfer member and imaging member portions within said transfer zone for a predetermined contact period not exceeding about 0.030 seconds.

2. The method defined in claim 1 wherein said predetermined contact period is in the range from about 0.015 to about 0.030 seconds.

3. The method defined in claim 1 or 2 wherein electrical biasing and contacting steps are effected by urging said transfer member portions into contact with said image member portions by means of electrically-biased, compliant conductive means having a smooth contacting surface.

4. The invention defined in claim 1 further comprising the step of varying said predetermined contact period to adjust for variation in an electrographic imaging parameter.

5. The invention defined in claim 4 wherein said contact period variation is effected by varying the velocity of movement of said image member and transfer member portions through said transfer zone.

6. The invention defined in claim 4 wherein said contact period variation is effected by varying the physical length of contact between said image member and transfer member portions in said transfer zone.

7. In a method of electrographic imaging using an electrically insulative imaging member, electrically non-insulative toner and a transfer member of high relative-conductivity, the improved toner transfer procedure comprising:

(a) moving successive portions of such an imaging member, bearing non-insulative toner having an induced charge of a first polarity, and successive portions of such transfer member through a transfer zone in opposing relation;

(b) electrically biasing the non-opposing surface of said transfer member at a predetermined potential, opposite in polarity to said first polarity; and (c) contacting said opposing transfer member portions with toner on said opposing imaging member portions for a period of predeterminedly limited duration such that the toner has a significant residual charge at the end of such period.

8. In apparatus of the kind having means for forming an electrically non-insulative toner image, bearing charge of a first polarity, on an electrically-insulative imaging member, a device for transferring such toner image to a transfer member of high relative-conductivity, said device comprising:

(a) means for transporting successive toner-bearing portions of such image member and such transfer member into opposing relation within a transfer zone;

(b) an electrically-conductive member coupled to a voltage source of predetermined potential and of a polarity opposite said first polarity, said electrically-conductive member being disposed for contacting the non-opposing surface of transfer member portions within said zone; and (c) means for controlling contact between successive image member and transfer member portions such that said contact extends for a predetermined period not exceeding 0.030 seconds.

9. The invention defined in claim 8 wherein said predetermined period is in the range of from about 0.015 to about 0.030 seconds.

10. The invention defined in claim 8 wherein said electrically-conductive member has a smooth compliant surface disposed to urge such transfer member portions into contact with such image member portions.

11. The invention defined in claim 10 wherein said surface of said conductive member is movable through said transfer zone in contact with such transfer member portions.

12. The invention defined in claim 8 further comprising adjusting means for varying said period of contact to adjust for variation in an electrographic imaging parameter.

13. The invention defined in claim 12 wherein said adjusting means comprises means for varying the velocity of transport of said image member and said transfer member.

14. The invention defined in claim 12 wherein said adjusting means comprises means for varying the physical length of contact between said image and transfer member portions.

* * * * *